US009251648B2

(12) United States Patent
Anderson et al.

(10) Patent No.: US 9,251,648 B2
(45) Date of Patent: Feb. 2, 2016

(54) MESSAGING TO AND FROM WAGERING GAME MACHINES

(71) Applicant: WMS Gaming, Inc., Waukegan, IL (US)

(72) Inventors: Peter R. Anderson, Glenview, IL (US); Edward Q. Earley, Chicago, IL (US); Jacob C. Greenberg, Elgin, IL (US); Michael R. Rudel, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/768,644

(22) Filed: Feb. 15, 2013

(65) Prior Publication Data

US 2013/0217478 A1 Aug. 22, 2013

Related U.S. Application Data

(60) Provisional application No. 61/600,238, filed on Feb. 17, 2012.

(51) Int. Cl.
*G07F 17/32* (2006.01)

(52) U.S. Cl.
CPC ..... *G07F 17/323* (2013.01); *G07F 17/3225* (2013.01)

(58) Field of Classification Search
None
See application file for complete search history.

(56) References Cited

U.S. PATENT DOCUMENTS 8,366,546 B1 * 2/2013 Naik et al. ..... 463/31
2009/0270166 A1 * 10/2009 Thukral et al. ..... 463/25
2009/0327060 A1 * 12/2009 Arezina et al. ..... 705/14.15
2010/0062840 A1 3/2010 Herrmann
2010/0144426 A1 * 6/2010 Winner et al. ..... 463/25
2010/0203963 A1 * 8/2010 Allen et al. ..... 463/30
2011/0028207 A1 * 2/2011 Gagner et al. ..... 463/25
2011/0159966 A1 * 6/2011 Gura et al. ..... 463/42
2011/0201414 A1 * 8/2011 Barclay et al. ..... 463/25
2011/0212785 A1 9/2011 Gura et al.
2011/0218044 A1 * 9/2011 Joshi et al. ..... 463/37
2011/0269532 A1 11/2011 Shuster et al.
2012/0015735 A1 * 1/2012 Abouchar et al. ..... 463/42
2012/0122561 A1 5/2012 Hedrick et al.
2012/0157211 A1 * 6/2012 Kane et al. ..... 463/42
2012/0184362 A1 7/2012 Barclay et al.
2012/0184363 A1 * 7/2012 Barclay et al. ..... 463/25
2012/0202587 A1 * 8/2012 Allen et al. ..... 463/25
2012/0202601 A1 8/2012 Gagner et al.
2012/0214564 A1 * 8/2012 Barclay et al. ..... 463/11
2013/0203481 A1 * 8/2013 Miller et al. ..... 463/25

* cited by examiner

*Primary Examiner* — Jason Yen
(74) *Attorney, Agent, or Firm* — DeLizio Law, PLLC

(57) ABSTRACT

A method includes receiving, at a host gaming server, notifications of account logins from a number of wagering game machines from at least one wagering game establishment. The method includes receiving, at the host gaming server, messages from multiple messaging sources that comprise at least one of a social networking website, a microblogging website, and at least some of the number of wagering game machines, wherein the messages comprise messages related to activity at the at least one wagering game establishment that include game play at the number of wagering game machines and messages related to activity external to the at least one wagering game establishment. The method includes aggregating, by the host gaming server, the messages from the multiple messaging sources. The method includes filtering, by the host gaming server, the messages for each of the account logins to create filtered messages.

31 Claims, 7 Drawing Sheets

MESSAGING TO AND FROM WAGERING GAME MACHINES

RELATED APPLICATIONS

This application claims the priority benefit of U.S. Provisional Application Ser. No. 61/600,238 filed Feb. 17, 2012.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to game play, and more particularly to messaging to and from a wagering game machine.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Figure 1:
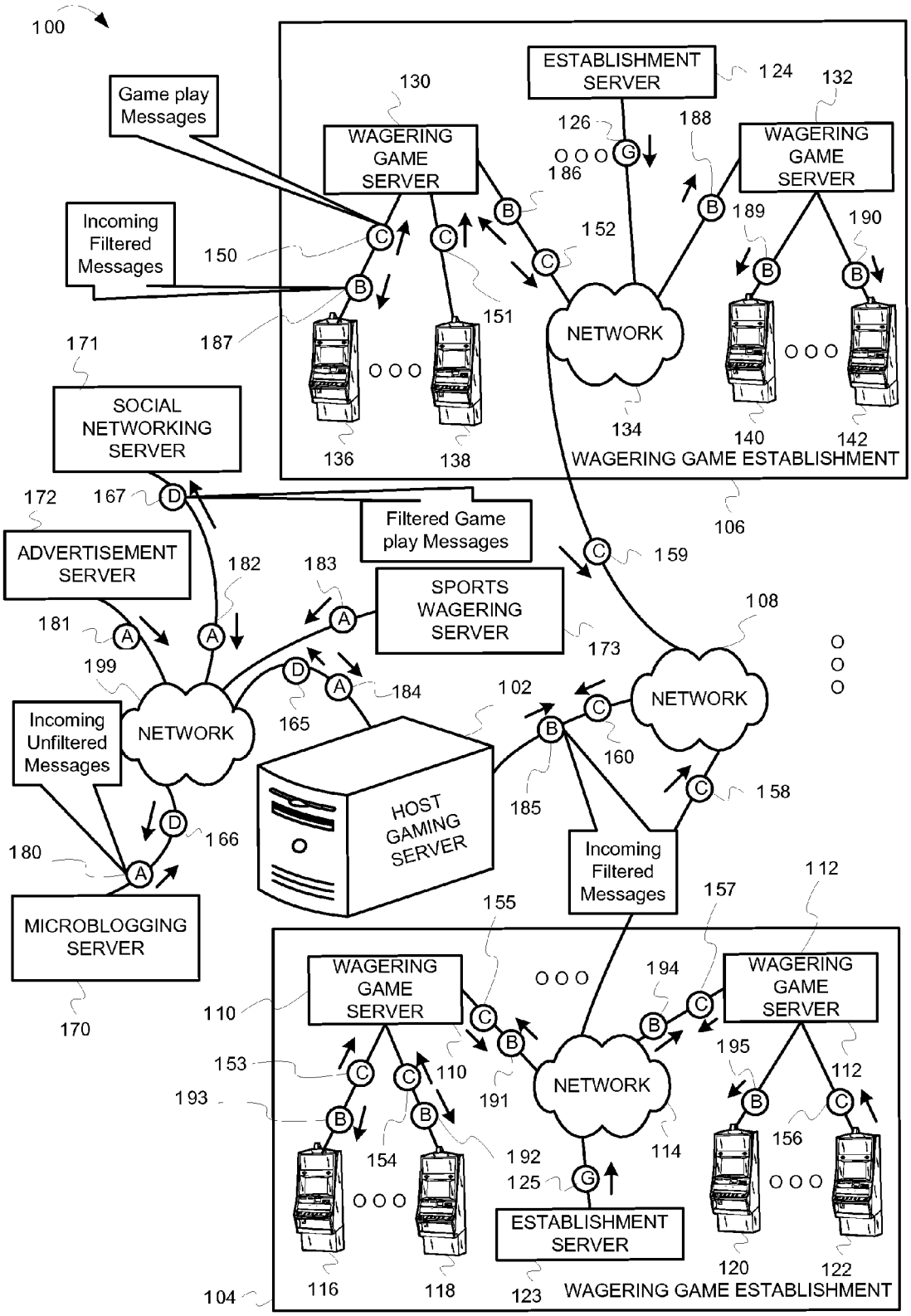
FIG. 1 depicts a system for filtered media messaging to and from wagering game machines, according to some example embodiments.

This description of the embodiments is divided into six sections. The first section provides an introduction to some example embodiments, while the second section provides a system environment. The third section describes example operations performed by some example embodiments. The fourth section describes an example wagering game machine architecture. The fifth section describes an example wagering game machine and the sixth section presents some general comments.

Introduction

This section provides an introduction to some example embodiments. Some example embodiments provide for aggregating and filtering of media messages that are received from various messaging sources. After the filtering, these media messages are downloaded to a number of different wagering game machines in one or more wagering game establishments. In some example embodiments, a host gaming server configured to communicate with a number of local wagering game servers in a number of wagering game establishments can serve as a gateway to provide for this aggregation and filtering of media messages for download into the wagering game machines. For example, these local wagering game servers can be associated with a bank of wagering game machines in a wagering game establishment. While operations as described as being performed by the host gaming server, in some example embodiments, some or all of these operations for aggregation and filtering can be performed by other components of the wagering game system. For example, some of the filtering can be performed by the local wagering game servers or the wagering game machines.

These messaging sources can be both internal and external to the wagering game establishments. For example, the messaging sources can include social networking websites, microblogging websites, news-based websites, sports wagering websites, the wagering game machines, local wagering game servers, etc. Additionally, the media messages can be any type of multimedia (e.g., text, images, video, audio, etc.). The media messages can relate to wagering game play and non-wagering game play activities. For example, the messages can be status updates, images, etc. from a social networking website. In another example, the messages can be blog entries posted on a microblogging website. In another example, the messages can be scores, updates, etc. related to sporting events from a sports wagering website. In another example, the messages can be related to wagering game play events at different wagering game machines at a same or different wagering game establishment relative to the wagering game machine to receive the messages. Examples of such wagering game play events can include a login by a wagering game player (e.g., player account login, loyalty card use, etc.), a win above a threshold amount, any win, a progressive jackpot win, etc.

The host wagering game server can receive (such as pull) and then aggregate these different messages from different messaging sources and different accounts of these messaging sources. This aggregation at the host gaming server enables the filtering of these different messages prior to their downloading to the different wagering game machines.

The host gaming server can filter the messages prior to downloading to the wagering game machines based on a number of different filters. These filters can be unique to individual wagering game players, a group of wagering game players, a group of wagering game machines, a particular wagering game establishment or groups of wagering game establishments, etc. Filters for the messages can be specific to a wagering game player such that the player receives status updates, etc. from their accounts at social networking websites or microblogging websites. Filters can be specific to the wagering game play. For example, the wagering game player only receives messages regarding wagering game play from specific themed wagering game machines. To illustrate, the wagering game player only receives game play messages regarding jackpot wins from the top three themed wagering game machines that the wagering game player has wagered at the most in the last six months. Filters can also be configured by different entities or persons (e.g., the operator of the wagering game establishment, the wagering game player, etc.). In another example, the wagering game player can receive game play messages that provide notification that one of a group of wagering game players ("friends" or "family") has logged into any wagering game machine.

The filtering can also include a reduction or change in the media in the message. For example, the filtering can change a video to an image, reduce the resolution of an image, etc. The filtering can also include scanning for any type of viruses to prevent the inclusion of any type of malware as part of the message. The filtering can also remove any type of inappropriate language or text. The filtering can remove any web links and can limit the total number of characters that can be displayed (e.g., 170 characters).

The filtering of the messages can include a prioritizing of the messages that are to be displayed. One order of prioritization is displaying of the most recent items or activities first. Another order of prioritization is displaying of items or activities from friends or family first. Another order of prioritization is displaying of game play messages for the game the player is currently playing, for the game the player has won the most monies within a given time period (e.g., the last 90 days), for game play activities that occurred in the same wagering game establishment as the establishment where the player is currently located, etc. These orders of prioritization can be integrated. So that messages from a social networking website from family and messages regarding game play that providing a jackpot win in the same wagering game establishment has the highest priority. This order of prioritization can be defined by the wagering game player or the operator of the wagering game establishment. Also, the operator of the wagering game establishment can override at least some of the priority defined by the wagering game player. For example, the operator can require the inclusion of some advertisement at a high priority.

In addition to aggregating and filtering messages to be downloaded to the wagering game machines, the host gaming server can also aggregate and filter messages flowing in the opposite direction. Specifically, the host gaming server can also filter messages coming from the wagering game machines for subsequent posting at one of a number of different external websites (social networking websites, microblogging websites, etc.). For example, the host gaming server can receive and aggregate different game play messages from different wagering game machines. In another example, a separate server in the wagering game establishment can be executing different operations (e.g., loyalty systems, guest services, etc.). This server can provide messages related to the loyalty points, guest services, etc. for the wagering game players. The host gaming server also receives or pulls such messages from this server. Then, the host gaming server can filter these messages. The host gaming server can then transmit these filtered messages to these websites. As an example, the messages can provide notification of account login, jackpot wins, etc. that are then posted to the wagering game player's account on a social networking website or a microblogging website. The notifications can be text-based, screenshots, video replays, etc. The filtering of such messages can preclude certain information from being posted regarding the wagering game activity. For example, the host gaming server can preclude the posting at an external website of the actual monetary amount won.

Accordingly, some example embodiments provide a single gateway for media messages being downloaded to and received from different wagering game machines across multiple wagering game establishments. This gateway provides for aggregation and filtering of these media messages based on various filtering criteria.

System Environment

This section describes an example system environment and presents structural aspects of some example embodiments. This section includes an example system and an example interface for presenting received messages on a wagering game machine. This section will discuss FIGS. 1-3. The discussion of FIG. 1 will describe a system that provides for aggregation and filtering of messages received from a multiple of different messaging sources and transmitting of filtered messages to different wagering game machines for display thereon. The discussion of FIG. 2 will describe an example architecture of a host gaming server that is to aggregate and filter messages received from the multiple of different messaging sources. The discussion of FIG. 3 will describe an example display of a wagering game machine for displaying filtered messages received from the host gaming server.

FIG. 1 depicts a system for filtered media messaging to and from wagering game machines, according to some example embodiments. In particular, FIG. 1 depicts a system 100 that includes a host gaming server 102 and a number of wagering game establishments (represented as a wagering game establishment 104 through a wagering game establishment 106). The system 100 also includes a number of external messaging sources. In this example, the external messaging sources include a number of servers external to the wagering game establishments. The external messaging sources include a microblogging server 170 (for hosting a microblogging website), a social networking server 171 (for hosting a social networking website), an advertisement server 172 (for providing advertisement messages), and a sports wagering server 173 (for hosting a sports wagering website).

The microblogging server 170, the social networking server 171, the advertisement server 172, the sports wagering server 173, and the host gaming server 102 are communicatively coupled together through a network 199. In some example embodiments, the network 199 is an unsecured network (e.g., Internet). As further described below, operations in the host gaming server 102 receives and filters messages over the network 199 from the different servers coupled thereto. Such filtering occurs prior to the messages being transmitted to the wagering game machines in the different wagering game establishments.

The wagering game establishment 104 includes a number of wagering game servers (represented as a wagering game server 110 through a wagering game server 112) and a number of wagering game machines (represented as wagering game machines 116 through 118 and wagering game machines 120 through 122). In some example embodiments, the wagering game servers 110-112 can be associated with a bank of wagering game machines for communications with the host gaming server 102. In this example, the wagering game server 110 is associated with the wagering game machines 116-118. The wagering game server 110 is communicatively coupled to the wagering game machines 116-118 and to a network 114. Also, the wagering game server 112 is associated with the wagering game machine 120-122. The wagering game server 112 is communicatively coupled to the wagering game machines 120-122 and to the network 114.

The wagering game establishment 106 includes a number of wagering game servers (represented as a wagering game server 130 through a wagering game server 132) and a number of wagering game machines (represented as wagering game machines 136 through 138 and wagering game machines 140 through 142). In some example embodiments, the wagering game servers 130-132 can be associated with a bank of wagering game machines for communications with the host gaming server 102. In this example, the wagering game server 130 is associated with the wagering game machines 136-138. The wagering game server 132 is communicatively coupled to the wagering game machines 140-142 and to a network 134. Also, the wagering game server 132 is associated with the wagering game machine 140-142. The wagering game server 132 is communicatively coupled to the wagering game machines 140-142 and to the network 134. The network 114 and the network 134 are communicatively coupled to a network 108. The host gaming server is also communicatively coupled to the network 108.

Figure 2:
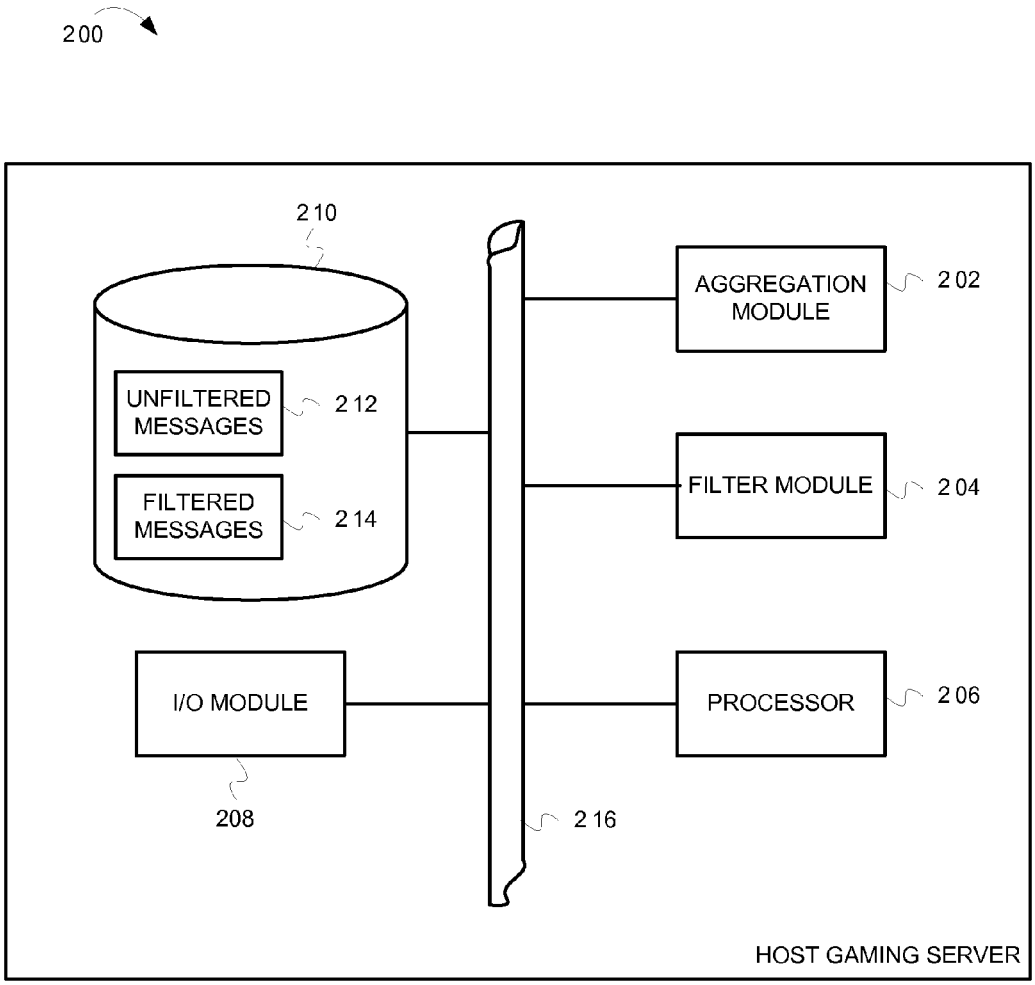
FIG. 2 depicts a block diagram illustrating a host gaming server architecture, according to some example embodiments.

A more detailed block diagram of an example architecture of the host gaming server 102 is depicted in FIG. 2, which is described in more detail below. The wagering game machines 116-118, 120-122, 136-138, and 140-142 can receive and transmit media messages from and to the host gaming server 102 through the wagering game servers 110, 112, 130, and 132, respectively. In particular, the wagering game servers 110-112 and 130-132 can provide an interface for their associated wagering game machines back to the host gaming server 102. For example, the messages can be exchanged between the wagering game machines and the host gaming server 102 through the wagering game servers.

In the system 100, there is transmission of different messages over the network. In some example embodiments, the transmission of messages between the wagering game machines, the wagering game server, and the host gaming server are based on a gaming communications protocol (e.g., Game-to-System (G2S)). The host gaming server 102 can aggregate media messages received from a number of different messaging sources. In the example of the system 100, the messaging sources include the microblogging server 170, the social networking server 171, the advertisement server 172, the sports wagering server 173, and the wagering game machines 116-118, 120-122, 136-138, and 140-142.

The host gaming server 102 receives messages 180 from the microblogging server 170, messages 181 from the advertisement server 172, messages 182 from the social networking server 171, and messages 183 from the sports wagering server 173—shown as circled As in FIG. 1. The messages 180-183 going into the host gaming server 102 are shown as messages 184—shown as circled A in FIG. 1.

The host gaming server 102 can receive identifications of wagering game players after they are logged into the wagering game machines. The host gaming server 102 can also receive an indication of whether the wagering game players desire to opt-in to receiving media messages during wagering game play at the wagering game machine. The host gaming server 102 can also provide a web service external to the wagering game establishments to allow the wagering game players to set up a player account that can be related but separate from their login account at the wagering game machines at the wagering game establishments. This external player account can enable the wagering game player to stay connected to the wagering game machines at the wagering game establishments. For example, the player can play nonwagering games that are linked to the wagering game machines at the wagering game establishments. The play of these nonwagering games can provide trophies, unlock bonuses, etc. for wagering game play at the wagering game machines.

Additionally, the player can connect their accounts associated with these different messaging sources to enable access to data therein. For example, the player can connect their account from the social networking website being hosted by the social networking server 171, their account from the microblogging server being hosted by the microblogging server 170, etc. The host gaming server 102 can then receive messages from these player accounts at the different messaging sources using an Application Programming Interface (API). While described herein as receiving the messages, in some example embodiments, the host gaming server 102 pulls the messages from the different messaging sources. Such pulling of messages can be an alternative or an addition to the receiving of the messages. The messages 182 received from the social networking server 171 can include status updates, videos, pictures, etc. from the accounts of the different wagering game players that have connected their social networking account to their player account. In another example, the messages 180 from the microblogging server 170 can include blog entries (text postings, videos, pictures, etc.) from those persons that are being followed by the wagering game players on their microblogging accounts. The messages 183 from the sports wagering server 173 and received by the host gaming server 102 can include scores, updates, etc. related to sporting events. The messages 181 from the advertisement server 172 can include different types of advertisements that can be integrated into the other types of messages that are to be displayed at the wagering game machines.

The host gaming server 102 can also receive messages from one or more of the wagering game machines 116-118, 120-122, 136-138, and 140-142. These messages can relate to different types of wagering game play. Examples of such wagering game play can include a login by a wagering game player (e.g., player account login, loyalty card use, etc.), a win above a threshold amount, any win, a progressive jackpot win, etc. The wagering game machines can be configured by the operator of the wagering game establishment, the wagering game players, etc. regarding whether these messages are transmitted back to the host gaming server 102, the types of messages, the data provided in such messages, etc. For example, some wagering game player can opt out of transmitting any messages back to the host gaming server 102. In another example, the operator of the wagering game establishment can prohibit any data regarding amounts of the wins being included in the messages. In another example, the wagering game player can prohibit the inclusion of their exact location for any messages, messages regarding a win above a threshold amount, etc.

In this example of FIG. 1, five of the eight wagering game machines are transmitting messages back to the host gaming server 102—shown as circled Cs in FIG. 1. In particular, the wagering game machine 136 and the wagering game machine 138 transmit messages 150 and messages 151, respectively, through the wagering game server 130 back to the host gaming server 102 (through the networks 134 and 108)—shown as messages 152, messages 159, and messages 160. The wagering game machine 116 and the wagering game machine 118 transmit messages 153 and messages 154, respectively, through the wagering game server 110 back to the host gaming server 102 (through the networks 114 and 108)—shown as messages 155, messages 158, and messages 160. The wagering game machine 122 transmits messages 156 through the wagering game server 112 back to the host gaming server 102 (through the networks 114 and 108)—shown as messages 157, messages 158, and messages 160.

Other messaging sources can be separate servers in the wagering game establishments. In this example, the wagering game establishment 104 includes an establishment server 123 that is communicatively coupled to the host gaming server 102 through the network 114 and the network 108. The wagering game establishment 106 includes an establishment server 124 that is communicatively coupled to the host gaming server 102 through the network 134 and the network 108. The establishment servers 123 and 124 can be executing different operations (e.g., loyalty systems, guest services, etc.). The establishment servers 123 and 124 can provide messages related to the loyalty points, guest services, etc. for the wagering game players to the host gaming server 102. The establishment server 123 transmits messages 126 and the establishment server 124 transmits messages 125 to the host gaming server 102.

The host gaming server 102 aggregates these different messages from these different messaging sources. The host gaming server 102 also filters these different messages. The filtering can be based on any of a number of different filtering criteria. These filters can be unique to individual wagering game players, a group of wagering game players, a group of wagering game machines, a particular wagering game establishment or groups of wagering game establishments, etc. Filters for the messages can be for specific to a wagering game player such that the player receives status updates, etc. from their accounts at social networking websites or microblogging websites. Filters can be specific to the wagering game play. For example, the wagering game player only receives messages regarding wagering game play from specific themed wagering game machines. To illustrate, the wagering game player only receives game play messages regarding progressive wins from the top three themed wagering game machines that the wagering game player has wagered at the most in the last six months and that are within the current wagering game establishment where the player is located. Filters can also be configured by different entities or persons (e.g., the operator of the wagering game establishment, the wagering game player, etc.). In another example, the wagering game player can receive game play messages that provide notification that one of a group of wagering game players ("friends" or "family") has logged into any wagering game machine.

The filtering can also include a reduction or change in the media in the message. For example, the filtering can change a video to an image, reduce the resolution of an image, etc. The filtering can also include scanning for any type of viruses to prevent the inclusion of any type of malware as part of the message. The filtering can also remove any type of inappropriate language or text. The filtering can remove any web links and can limit the total number of characters that can be displayed (e.g., 170 characters). The filtering of the messages can include a prioritizing of the messages that are to be displayed. One order of prioritization is displaying of the most recent items or activities first. Another order of prioritization is displaying of items or activities from friends or family first. Another order of prioritization is displaying of game play messages for the game the player is currently playing, for the game the player has won the most monies within a given time period (e.g., the last 90 days), for game play activities that occurred in the same wagering game establishment as the establishment where the player is currently located, etc. These orders of prioritization can be integrated. So that messages from a social networking website from family and messages regarding game play that providing a jackpot win in the same wagering game establishment has the highest priority. This order of prioritization can be defined by the wagering game player or the operator of the wagering game establishment. Also, the operator of the wagering game establishment can override at least some of the priority defined by the wagering game player. For example, the operator can require the inclusion of some advertisement at a high priority.

After filtering, the host gaming server 102 downloads the filtered messages to the wagering game machines that are configured to receive the messages—shown as circled Bs in FIG. 1. For example, the host gaming server 102 can transmit a first group of messages to a first wagering game machine based on a first filtering criteria, a second group of messages to a second wagering game machine based on a second filtering criteria, etc. In this example, the filtered messages are shown as messages 185 that are then dispersed over the networks based on their destinations to different wagering game establishments and different wagering game machines therein. In particular, messages 186 and messages 188 are transmitted to the wagering game machines at the wagering game establishment 106. The messages 186 are downloaded to the wagering game machine 136 through the wagering game server 130—shown as messages 187. The messages 188 are downloaded to the wagering game machine 140 and the wagering game machine 142 through the wagering game server 132—shown as messages 189 and messages 190, respectively. Messages 191 and messages 194 are transmitted to the wagering game machines at the wagering game establishment 104. The messages 194 are downloaded to the wagering game machine 120 through the wagering game server 112—shown as messages 195. The messages 191 are downloaded to the wagering game machine 116 and the wagering game machine 118 through the wagering game server 110—shown as messages 193 and messages 192, respectively.

Accordingly, the host gaming server 102 can provide for aggregation and filtering of messages from different messaging services based on a number of different filtering criteria. Also, the host gaming server 102 can then download these filtered messages to particular wagering game machines across different wagering game establishments. As described above, the downloaded filtered messages can be based a filter that is specific to the wagering game player that is logged in and playing the wagering game machine.

The host gaming server 102 can also aggregate and filter messages that are to be downloaded to accounts that are external to the wagering game establishments. Specifically, the host gaming server 102 can also filter messages coming from the wagering game machines for subsequent posting at one of a number of different external websites (the social networking website being hosted by the social networking server 171, the microblogging website being hosted by the microblogging server 170, etc.).

For example, the host gaming server 102 can receive (and/or pull) and aggregate different game play messages from different wagering game machines. Then, the host gaming server 102 can filter these messages. The filtering can be based on filtering criteria defined by the wagering game player creating the wagering game play described in the game play messages; the operator of the wagering game establishment where the wagering game play occurred, etc. For example, the operator of the wagering game establishment can prohibit any data regarding amounts of the wins being included in the messages. In another example, the wagering game player can prohibit the inclusion of their exact location for any messages, messages regarding a win above a threshold amount, etc.

The host gaming server 102 can then transmit these filtered messages to the servers for these websites. As an example, the messages can provide notification of account login, jackpot wins, etc. that are then posted to the wagering game player's account on the social networking website hosted by the social networking server 171 or their account on the microblogging website hosted by the microblogging server 170. The game play messages can be text-based, screenshots, video replays, etc. Additionally, the game play messages can include links as part of a text message to enable a person to access a screenshot or video replay of the game play, to access an online website to enable game play (non-wagering) or actual wagering game play. The filtering of such messages can preclude certain information from being posted regarding the wagering game activity. For example, the host gaming server 102 can preclude the posting at an external website of the actual monetary amount won, of any progressive jackpot wins, etc.

In this example of FIG. 1, the host gaming server 102 is transmitting filtered messages to the social networking server 171 for posting on a social network website and the microblogging server 170 for posting on a microblogging website—shown as circled Ds in FIG. 1. In particular, the host gaming server 102 transmits messages 165 that are then transmitted as messages 166 to the microblogging server 170 and messages 167 to the social networking server 171 (through the network 199).

In some example embodiments, the system 100 is configured such that the communications between the host gaming server 102 and the wagering game servers 110, 112, 130, and 132 are not bi-directional. In such a configuration, the communications can be uni-directional such that the messages are transmitted from the wagering game servers 110, 112, 130, and 132 to the host gaming server 102 (but not vice versa). Accordingly, the host gaming server 102 receives and aggregates the messages from the different messaging sources and transmits filtered messages to the servers external to the wagering game establishments (e.g., the social networking server 171 and the microblogging server 170). However, in this configuration, the host gaming server 102 would not transmit the filtered messages to the wagering game machines or other components in the wagering game establishments.

FIG. 2 depicts a block diagram illustrating a host gaming server architecture, according to some example embodiments. FIG. 2 depicts a host gaming server 200 that can be representative of the host gaming server 102 of FIG. 1. The host gaming server 200 includes an aggregation module 202, a filter module 204, a processor 206, an Input/Output (I/O) module 208, and a nonvolatile machine-readable media 210 that are communicatively coupled together through a communication bus 216.

The aggregation module 202, the filter module 204, and the I/O module 208 can be software, firmware, hardware or a combination thereof. For example, the aggregation module 202, the filter module 204, and the I/O module 208 can be software executing on the processor 206. The nonvolatile machine-readable media 210 is configured to store unfiltered messages 212 and filtered messages 214. The aggregation module 202 can perform operations for aggregating and storing the messages from the different messaging sources (as described herein). The filter module 204 can perform operations for filtering the aggregated messages based on the different filtering criteria (as described herein). The I/O module 208 can receive the messages and transmit the filtered messages to the different devices (as described herein).

Figure 3:
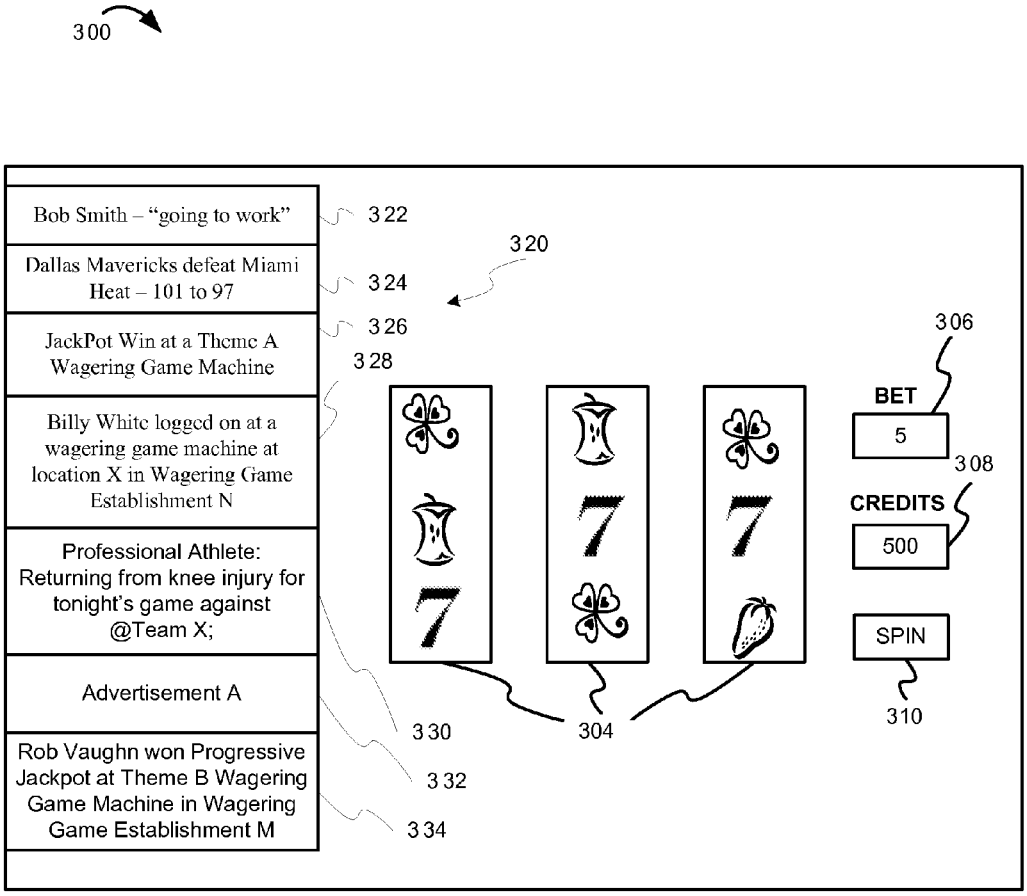
FIG. 3 depicts a display of a wagering game machine for display filtered media messages, according to some example embodiments.

An example of filtered media messages being displayed is now described. In particular, FIG. 3 depicts a display of a wagering game machine for display filtered media messages, according to some example embodiments. In particular, FIG. 3 depicts a display 300 of a wagering game machine providing wagering game play by wagering game players. For example with reference to FIG. 1, the display 300 can be a display for the wagering game machines 116-118, 120-122, 136-138, and 140-142

The display 300 includes reels 304 that are part of a slot wagering game play. The display 300 also includes a window 436 to display the amount being wagered for a spin of the reels 304. A window 308 displays the amount of game credit that the wagering game player has available on the device. A button 310 is selectable by the wagering game player to initiate wagering game play by spinning of the reels 304.

The display 300 also includes a message ticker 320 for displaying the different media messages being received from the host gaming server 102. In this example, the message ticker 320 is positioned on the left-hand side and includes different text-based messages from different messaging sources—a message 322, a message 324, a message 326, a message 328, a message 330, a message 332, and a message 334. In some example embodiments, the message ticker 320 can be positioned in other locations on the display 300, on a secondary display of the wagering game machine, etc. Also in some example embodiments, the messages can include other types of media (e.g., images, video, audio, etc.).

The message 322 is a message from a social networking website that provides a status update "going to work" for a friend (Bob Smith) of the wagering game player logged in at the wagering game machine. The message 324 is a message from a sports wagering website, a sports news website, etc. that provides a final score of a basketball game. The message 326 is a message from a different wagering game machine (in a same or different wagering game establishment) that provides notification of a jackpot win for a wagering game machine having theme A.

The message 328 is a message from a different wagering game machine (in a same or different wagering game establishment) that provides notification of an account login by a different wagering game player (Billy White) at a particular wagering game machine in a particular wagering game establishment. For example, this different wagering game player can be considered a friend of the current wagering game player, wherein this different wagering game player gives access to this information to his friends, family, or any other defined group of wagering game players. The message 330 is a message of an example blog entry from a microblogging account of a particular professional athlete that the current wagering game player is following on a microblogging website. The blog entry is an update from the particular professional athlete that provides an update regarding their injury.

The message 332 is a message providing an advertisement from an advertisement server that can be incorporated into the message ticker. Such advertising can generate revenue for the operator of the wagering game establishment where the wagering game machine is located. The message 334 is a message from a different wagering game machine (in a same or different wagering game establishment) that provides notification of a progressive win by a different wagering game player at a particular wagering game machine in a particular wagering game establishment. Similar to above, this different wagering game player can be considered a friend of the current wagering game player, wherein this different wagering game player gives access to this information to his friends, family, or any other defined group of wagering game players.

Example Operations

This section describes operations associated with some example embodiments. In the discussion below, the flow charts will be described with reference to the block diagrams presented above. However, in some example embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 4:
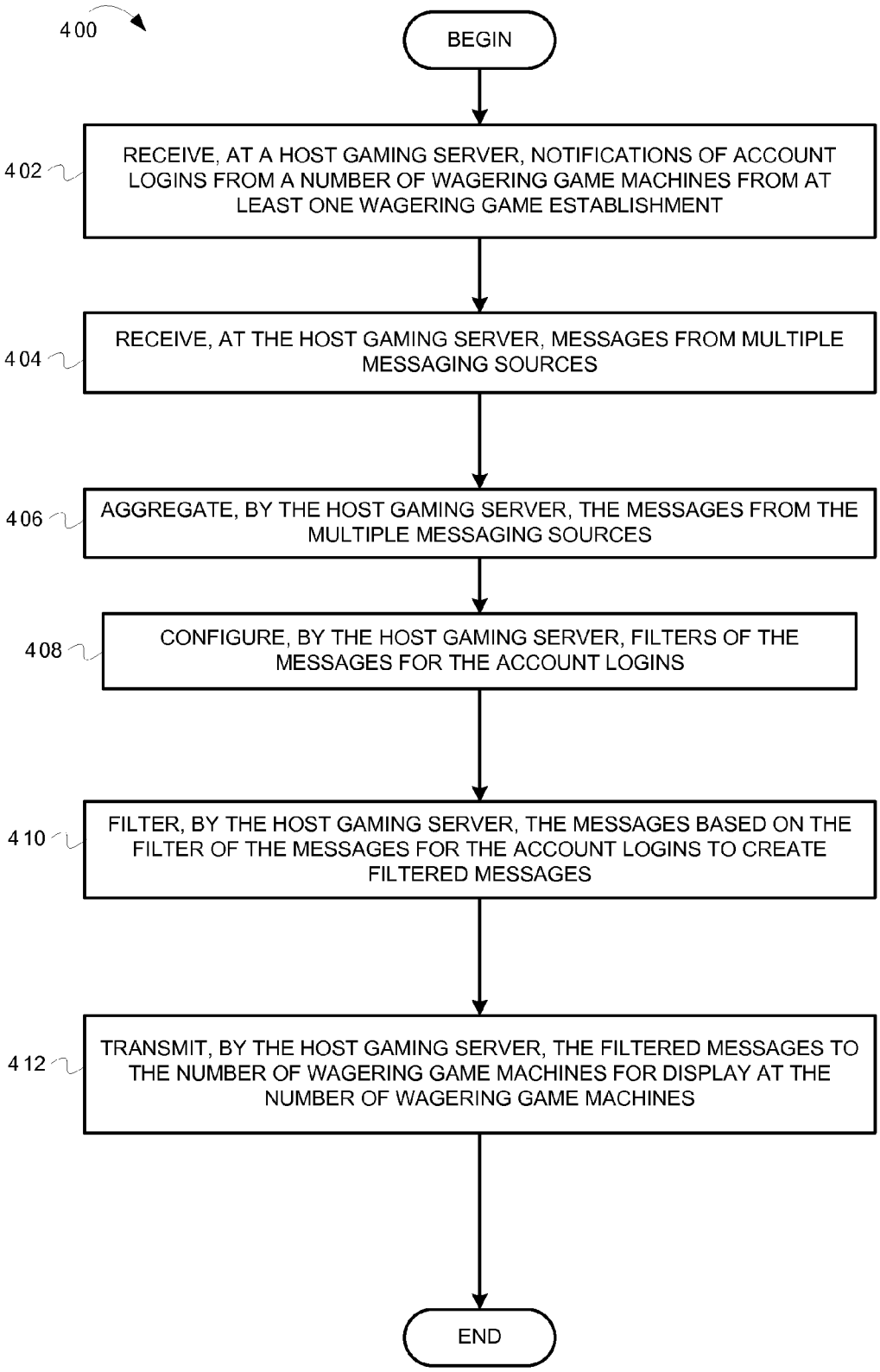
FIG. 4 depicts a flowchart of operations by a host gaming server for aggregation and filtering of media messages, according to some example embodiments.
Figure 5:
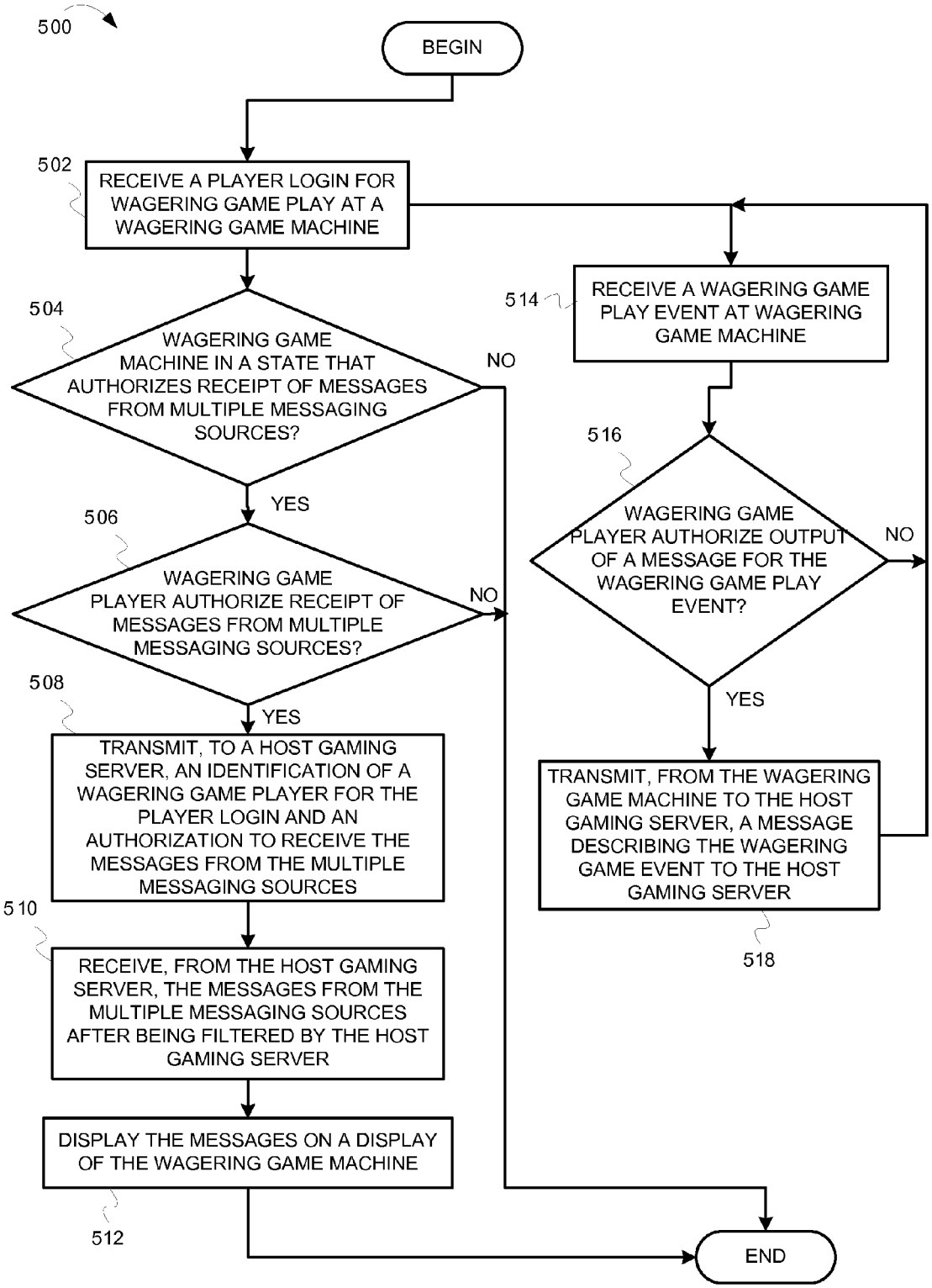
FIG. 5 depicts a flowchart of operations by a wagering game machine for processing of incoming and outgoing media messages, according to some example embodiments.

The section will discuss FIGS. 4-5. The discussion of FIG. 4 will describe operations performed by a host gaming server for aggregating, filtering and downloading of messages into wagering game machines. The discussion of FIG. 5 will describe operations performed by a wagering game machine for receiving and transmitting of messages.

FIG. 4 depicts a flowchart of operations by a host gaming server for aggregation and filtering of media messages, according to some example embodiments. The operations of a flowchart 400 are described in reference to FIGS. 1-2. The operations can be performed by the different modules of a host gamin server illustrated in FIG. 2. Also, at least some of these operations can be performed asynchronously relative to each other and can overlap at times. For example, notifications of new player logins can continue to occur while aggregating, filtering and transmitting messages to current player logins. The operations of the flowchart 400 begin at block 402.

At block 402, the host gaming server receives notifications of account logins from a number of wagering game machines from at least one wagering game establishment. For example with reference to FIGS. 1-2, the I/O module 208 of the host gaming server 102 receives notifications of different account logins of different wagering game players at wagering game machines at one or more different wagering game establishments. This receiving of notifications can occur asynchronously and can continue to occur as the other operations described in FIG. 4 are being performed. The account logins can be logins of player accounts for the specific wagering game establishment, logins of player accounts for specific wagering game manufacturers; use of a loyalty card or any other type of player access that identifies the wagering game player. Operations of the flowchart 400 continue at block 404.

At block 404, the host gaming server 102 receives messages from multiple messaging sources. For example with reference to FIGS. 1-2, the I/O module 208 can receive the messages from one or more of the microblogging server 170, the social networking server 171, the advertisement server 172, the sports wagering server 173 or any of the wagering game machines 116-118, 120-122, 136-138, and 140-142. Operations of the flowchart 400 continue at block 406.

At block 406, the host gaming server 102 aggregates the messages from the multiple messaging sources. For example with reference to FIGS. 1-2, the aggregation module 202 aggregates messages received from the multiple messaging sources. The aggregation module 202 can also store these messages in the nonvolatile machine-readable media 210. Operations of the flowchart 400 continue at block 408.

At block 408, the host gaming server 102 configures filters of the messages for the account logins. For example with reference to FIGS. 1-2, the filter module 204 can configure these filters. These filters can be unique to individual wagering game players, a group of wagering game players, a group of wagering game machines, a particular wagering game establishment or groups of wagering game establishments, etc. Filters for the messages can be for specific to a wagering game player such that the player receives status updates, etc. from their accounts at social networking websites or microblogging websites. Filters can be specific to the wagering game play. For example, the wagering game player only receives messages regarding wagering game play from specific themed wagering game machines. To illustrate, the wagering game player only receives game play messages regarding jackpot wins from the top three themed wagering game machines that the wagering game player has wagered at the most in the last six months. Filters can also be configured by different entities or persons (e.g., the operator of the wagering game establishment, the wagering game player, etc.). In another example, the wagering game player can receive game play messages that provide notification that one of a group of wagering game players ("friends" or "family") has logged into any wagering game machine. The filtering can also include a reduction or change in the media in the message. For example, the filtering can change a video to an image, reduce the resolution of an image, etc. The filtering can also include scanning for any type of viruses to prevent the inclusion of any type of malware as part of the message. The filtering can also remove any type of inappropriate language or text. The filtering can remove any web links and can limit the total number of characters that can be displayed (e.g., 170 characters). The filtering of the messages can include a prioritizing of the messages that are to be displayed. One order of prioritization is displaying of the most recent items or activities first. Another order of prioritization is displaying of items or activities from friends or family first. Another order of prioritization is displaying of game play messages for the game the player is currently playing, for the game the player has won the most monies within a given time period (e.g., the last 90 days), for game play activities that occurred in the same wagering game establishment as the establishment where the player is currently located, etc. These orders of prioritization can be integrated. So that messages from a social networking website from family and messages regarding game play that providing a jackpot win in the same wagering game establishment has the highest priority. This order of prioritization can be defined by the wagering game player or the operator of the wagering game establishment. Also, the operator of the wagering game establishment can override at least some of the priority defined by the wagering game player. For example, the operator can require the inclusion of some advertisement at a high priority. Operations of the flowchart 400 continue at block 410.

At block 410, the host gaming server 102 filters the messages based on the filter of the messages for the account logins to create filtered messages. For example with reference to FIGS. 1-2, the filter module 204 performs the filtering of the messages based on the filters configured for the different account logins. Operations of the flowchart 400 continue at block 412.

At block 412, the host gaming server 102 transmits the filtered messages to the number of wagering game machines for display at the number of wagering game machines. For example with reference to FIGS. 1-2, the I/O module 208 transmits the filtered messages to one or more of the number of wagering game machines 116-118, 120-122, 136-138, and 140-142 based on the player that is logged in. Accordingly, different wagering game machines can receive different filtered messages based on the player that is logged in. Operations of the flowchart 400 are complete.

Figure 6:
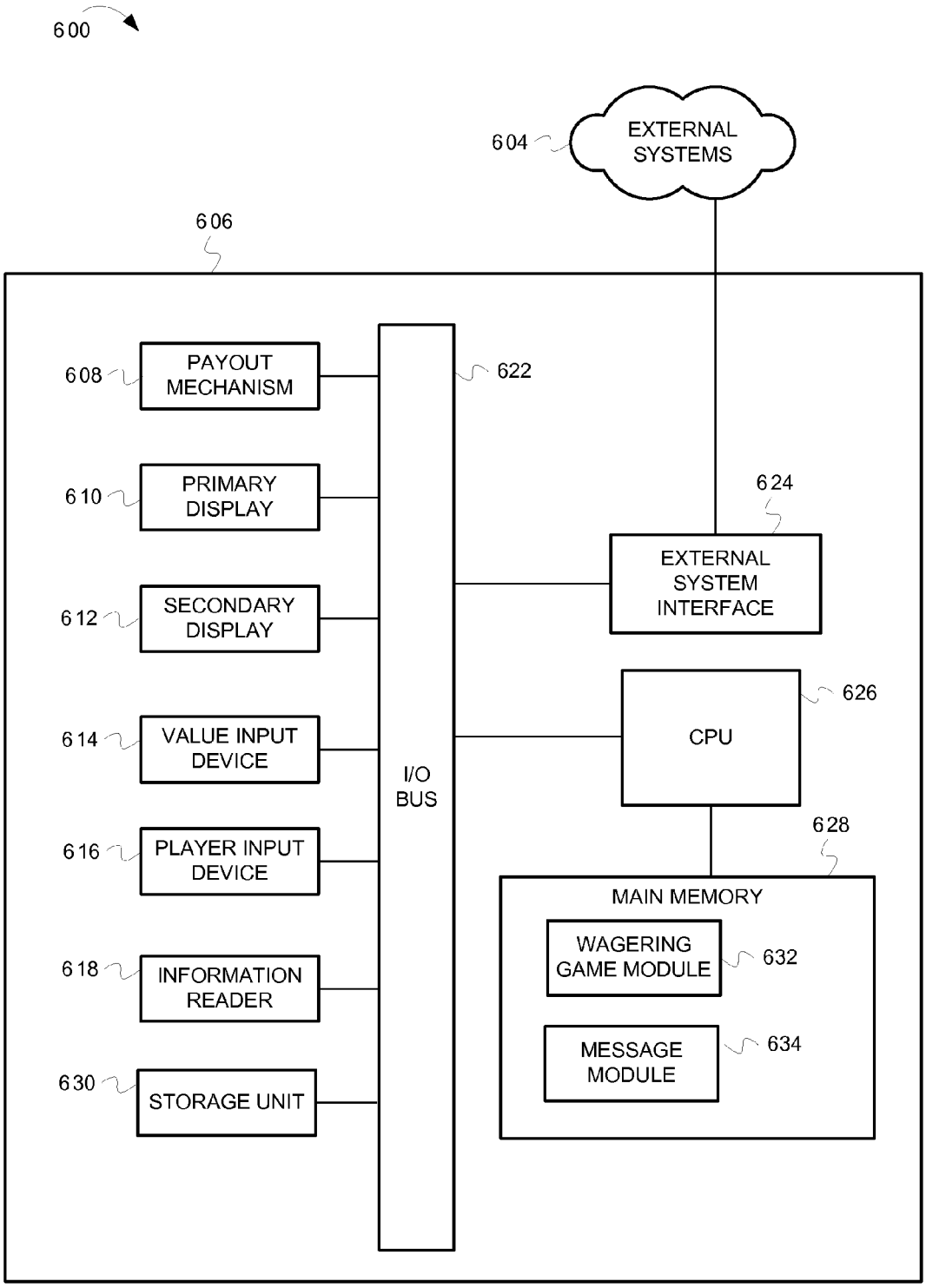
FIG. 6 depicts a block diagram illustrating a wagering game machine architecture, according to some example embodiments.
Figure 7:
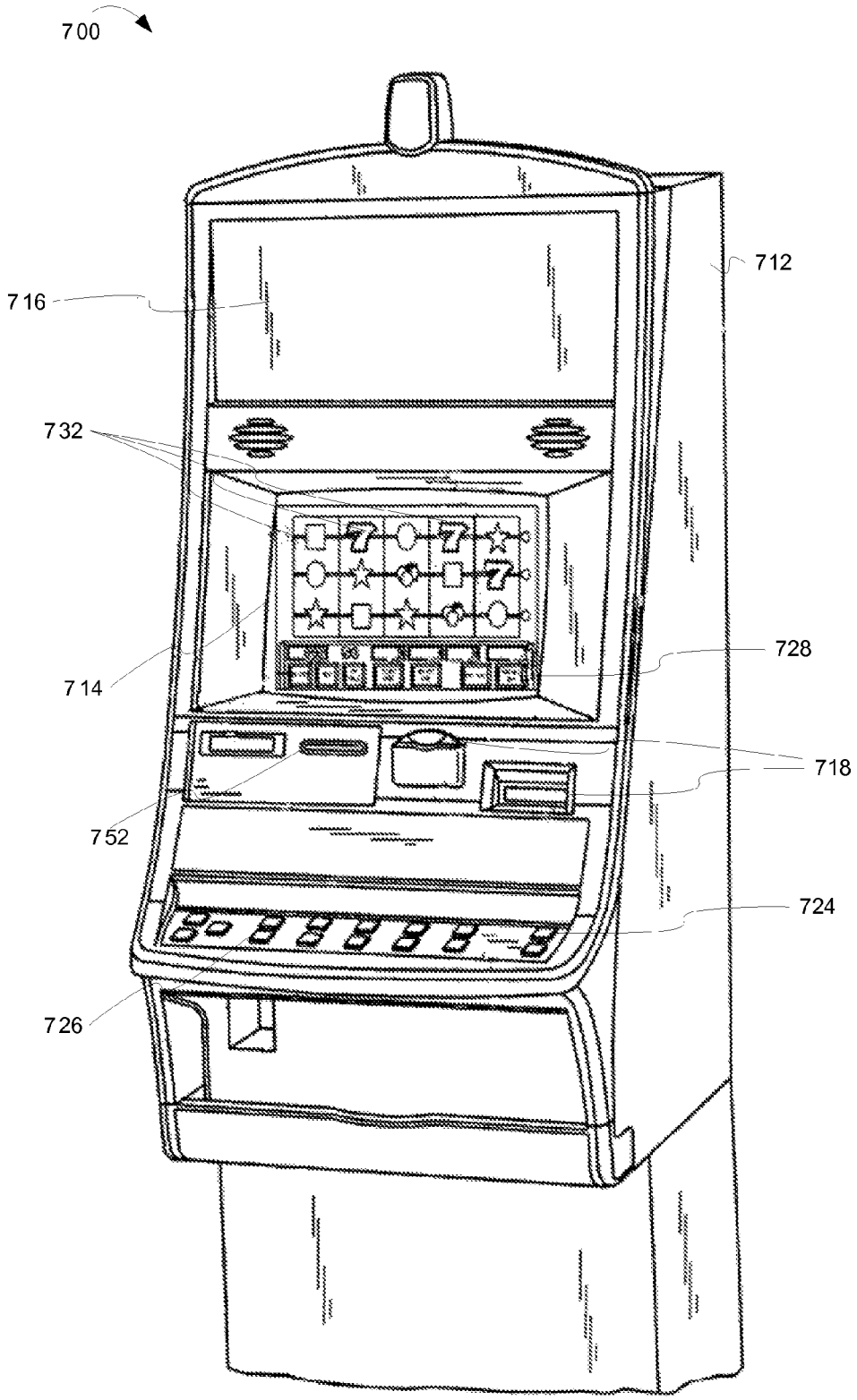
FIG. 7 depicts a perspective view of a wagering game machine, according to some example embodiments.

FIG. 5 depicts a flowchart of operations by a wagering game machine for processing of incoming and outgoing media messages, according to some example embodiments. The operations of a flowchart 500 are described in reference to FIG. 1. Also, the operations are described as being performed by a message module and a wagering game module that are executable within a wagering game machine. An example of a wagering game machine architecture having a message module is illustrated in FIG. 6 (which is described in more detail below). The flowchart 500 includes two different paths. A first path (including blocks 502-512) describes operations for receiving and processing of messages received from the host gaming server. A second path (including blocks 502 and 514-518) describe operations for transmitting messages to the host gaming server. These different groups of operations can be performed at least partially in parallel. The operations of the flowchart 500 begin at block 502.

At block 502, a wagering game module executing in a wagering game machine receives a player login for wagering game play at the wagering game machine. As described above, the account logins can be logins of player accounts for the specific wagering game establishment, logins of player accounts for specific wagering game manufacturers; use of a loyalty card or any other type of player access that identifies the wagering game player. Operations of the flowchart 500 continue at block 504 and block 514.

At block 504, a message module executing in the wagering game machine determines whether the wagering game machine in a state that authorizes receipt of messages from multiple messaging sources. Examples of different states can include active wagering game play or idle. In some example embodiments, active wagering game play is defined as any monetary amount being wagered within a defined time threshold (e.g., last 30 seconds, last minute, etc.). In some example embodiments, active wagering game play is defined as a monetary amount being wagered that is above a monetary threshold (e.g., one dollar, 10 dollars, 50 dollars, etc.) within a define time threshold. In some example embodiments, active wagering game play is defined as having any monies deposited in the wagering game machine for wagering game play. In some example embodiments, active wagering game play is defined as having monies deposited in the wagering game machine for wagering game play that is above a monetary threshold. If the state of the wagering game machine is not defined as active wagering game play, the state is considered idle. In some example embodiments, the state that authorizes receipt of messages is active wagering game play. In some example embodiments, the state is not checked and the messages are received regardless of the state of the wagering game machine. If the wagering game machine is in a state that authorizes receipt of messages, operations of the flowchart 500 continue at block 506. Otherwise, operations of the flowchart 500 (for this first path) are complete.

At block 506, the message module executing in the wagering game machine determines whether the wagering game player authorized receipt of messages from multiple messaging sources. In particular, the wagering game player can be presented the option after login to receive these messages or this option can be part of their configuration settings. Accordingly, the message module verifies the player authorization of whether any messages are received, only a specific group or type of messages (e.g., only game play messages from other wagering game machines in the same wagering game establishment), etc. If the wagering game player did authorize, operations of the flowchart 500 continue at block 508. Otherwise, operations of the flowchart 500 (for this first path) are complete.

At block 508, the message module executing in the wagering game machine transmits, to the host gaming server, an identification of a wagering game player for the player login and an authorization to receive the messages from the multiple messaging sources. For example with reference to FIG. 1, the message modules in the wagering game machines can transmit the identification and authorization (including any limits on the types of messages) over the networks 114/134 and 108 to the host gaming server 102. Operations of the flowchart 500 continue at block 504.

At block 510, the message module executing in the wagering game machine receives, from the host gaming server, the messages from the multiple messaging sources after being filtered by the host gaming server. For example with reference to FIG. 1, the message modules in the wagering game machines can the messages over the networks 114/134 and 108 from the host gaming server 102. Operations of the flowchart 500 continue at block 504.

At block 512, the message module executing in the wagering game machine displays the messages on a display of the wagering game machine. For example with reference to FIG. 3, the message module can display the messages on the display 300. As described above in some example embodiments, the messages can be displayed in other formats, different locations on the main display or in secondary displays of the wagering game machine. Operations of the flowchart 500 (for this first path) are complete.

At block 514, the message module executing in the wagering game machine receives a wagering game play event at wagering game machine. Examples of such wagering game play events can include a login by a wagering game player (e.g., player account login, loyalty card use, etc.), a win above a threshold amount, any win, a progressive jackpot win, etc. Operations of the flowchart 500 continue at block 516.

At block 516, the message module executing in the wagering game machine determines whether the wagering game player authorized output of a message for the wagering game play event. The wagering game player can authorize messages for all, some or no wagering game play events. For example, the player can authorize transmission of messages for events related to wins wherein the message does not identify the player, the amount or their location. If the wagering game player did authorize output of the message, operations of the flowchart 500 continue at block 518. Otherwise, operations of the flowchart 500 (for this second path) return to block 514 to receive the next wagering game play event.

At block 518, the message module executing in the wagering game machine transmits, from the wagering game machine to the host gaming server, a message describing the wagering game event to the host gaming server. Operations of the flowchart 500 (for this second path) return to block 514 to receive the next wagering game play event. The operations for this second path can continue until the wagering game player logs off their account from this wagering game machine.

Wagering Game Machine Architecture

This section describes an example wagering game architecture. FIG. 6 depicts a block diagram illustrating a wagering game machine architecture, according to some example embodiments. As shown in FIG. 6, the wagering game machine architecture 600 includes a wagering game machine 606, which includes a central processing unit (CPU) 626 connected to main memory 628. The CPU 626 can include any suitable processor, such as an Intel® Pentium processor, Intel® Core 2 Duo processor, AMD Opteron™ processor, or UltraSPARC processor. The main memory 628 includes a wagering game module 632 and a message module 634. In some example embodiments, the wagering game module 632 can present wagering games, such as video poker, video black jack, video slots, video lottery, etc., in whole or part. The message module 634 can receive, transmit and process messages (as described herein).

The CPU 626 is also connected to an input/output (I/O) bus 622, which can include any suitable bus technologies, such as an AGTL+ frontside bus and a PCI backside bus. The I/O bus 622 is connected to a payout mechanism 608, primary display 610, secondary display 612, value input device 614, player input device 616, information reader 618, and storage unit 630. The player input device 616 can include the value input device 614 to the extent the player input device 616 is used to place wagers. The I/O bus 622 is also connected to an external system interface 624, which is connected to external systems 604 (e.g., wagering game networks).

In one embodiment, the wagering game machine 606 can include additional peripheral devices and/or more than one of each component shown in FIG. 6. For example, in one embodiment, the wagering game machine 606 can include multiple external system interfaces 624 and/or multiple CPUs 626. In one embodiment, any of the components can be integrated or subdivided.

Any component of the architecture 600 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

In some example embodiments, the wagering game machine architecture can have a separate set of hardware, firmware and software for processing the messages. Accordingly, the additional components can include a separate external system interface, processor, volatile and non-volatile machine-readable media, etc. for receiving and processing the messages as described herein. Also instead of the video output from the CPU 626 being coupled to primary display 610, the video output is coupled to this additional processor for processing the messages. This additional processor can then combine the conventional wagering game play video output (e.g., spinning reels, etc.) from the CPU 626 with the messages to create a combined image that is then displayed on the primary display 610. Accordingly, the message module 634 can be executing in this additional processor (separate from the CPU 626).

Example Wagering Game Machine

FIG. 10 depicts a perspective view of a wagering game machine, according to some example embodiments. Referring to FIG. 10, a wagering game machine 1000 is used in gaming establishments, such as casinos. According to embodiments, the wagering game machine 1000 can be any type of wagering game machine and can have varying structures and methods of operation. For example, the wagering game machine 1000 can be an electromechanical wagering game machine configured to play mechanical slots, or it can be an electronic wagering game machine configured to play video casino games, such as blackjack, slots, keno, poker, blackjack, roulette, etc.

The wagering game machine 1000 comprises a housing 1012 and includes input devices, including value input devices 1018 and a player input device 1024. For output, the wagering game machine 1000 includes a primary display 1014 for displaying information about a basic wagering game. The primary display 1014 can also display information about a bonus wagering game and a progressive wagering game. The wagering game machine 1000 also includes a secondary display 1016 for displaying wagering game events, wagering game outcomes, and/or signage information. While some components of the wagering game machine 1000 are described herein, numerous other elements can exist and can be used in any number or combination to create varying forms of the wagering game machine 1000.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or barcode scanners for reading information stored on vouchers, cards, or other tangible portable storage devices. The vouchers or cards can authorize access to central accounts, which can transfer money to the wagering game machine 1000.

The player input device 1024 comprises a plurality of push buttons on a button panel 1026 for operating the wagering game machine 1000. In addition, or alternatively, the player input device 1024 can comprise a touch screen 1028 mounted over the primary display 1014 and/or secondary display 1016.

The various components of the wagering game machine 1000 can be connected directly to, or contained within, the housing 1012. Alternatively, some of the wagering game machine's components can be located outside of the housing 1012, while being communicatively coupled with the wagering game machine 1000 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 1000. Alternatively, the primary display 1014 can include a number of mechanical reels to display the outcome. In FIG. 10, the wagering game machine 1000 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 1000. In yet another embodiment, the wagering game machine 1000 can exhibit any suitable form factor, such as a free standing model, bartop model, mobile handheld model, or workstation console model.

A player begins playing a basic wagering game by making a wager via the value input device 1018. The player can initiate play by using the player input device's buttons or touch screen 1028. The basic game can include arranging a plurality of symbols along a payline 1032, which indicates one or more outcomes of the basic game. Such outcomes can be randomly selected in response to player input. At least one of the outcomes, which can include any variation or combination of symbols, can trigger a bonus game.

In some embodiments, the wagering game machine 1000 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

receiving, at a host gaming server, a notification of an account login from a first wagering game machine at a wagering game establishment, wherein the first wagering game machine comprises a first input device configured to detect a physical item associated with a monetary value that establishes a credit balance and a second input device configured to receive a cashout input that initiates a payout from the credit balance;

receiving, at the host gaming server, messages from a social networking website and a second wagering game machine at the wagering game establishment, wherein the messages indicate game play at the second wagering game machine, and activities inside and outside of the wagering game establishment;

aggregating, by the host gaming server, the messages;

configuring, by the host gaming server, a filter derived from at least one account information associated with the account login and a theme associated with the second wagering game machine;

filtering, by the host gaming server, the messages based on the filter to create filtered messages; and transmitting, by the host gaming server, the filtered messages, and wagering game information for presenting a wagering game on a display device of the first wagering game machine, wherein an outcome of the wagering game is based on one or more random elements generated by a random number generator, and wherein a tangible award is credited for the outcome.

2. The method of claim 1, wherein the filter varies based on a game play state of the first wagering game machine.

3. The method of claim 2, wherein the filtered messages are displayed at the first wagering game machine, in response to the game play state being in an active state.

4. The method of claim 2, wherein the filtered messages are displayed at the first wagering game machine, in response to at least one of a game play rate at the first wagering game machine exceeding a game play rate threshold, and a coin-in rate exceeding a coin-in threshold.

5. The method of claim 1, wherein the configuring of the filter is based on input from an operator of the wagering game establishment.

6. The method of claim 1, further comprising transmitting, by the host gaming server, at least some of the messages related to the activity at the wagering game establishment to the social networking website for posting, on the social networking website, a notification of the activity that occurred at the wagering game establishment.

7. The method of claim 1, wherein the theme of the second wagering game machine is within a subset of themes of wagering game machines where money wagered is the most within a defined time period.

8. The method of claim 1, wherein the messages that indicate game play at the second wagering game machine relate to the theme that is the same as a theme of the first wagering game machine.

9. A method comprising:

receiving, via an input device, a player login for play of a wagering game at a wagering game machine, wherein the wagering game machine comprises a first input device configured to detect a physical item associated with a monetary value that establishes a credit balance and a second input device configured to receive a cash-out input that initiates a payout from the credit balance;

initiating play of the wagering game;

determining an outcome of the wagering game based, at least in part, on one or more random elements generated by a random number generator;

displaying, on at least one display device, the outcome;

awarding a tangible award in response to the outcome meeting a predetermined award criterion; and in response to the wagering game machine being in a state that authorizes receipt of messages from multiple messaging sources that comprise at least one of a social networking website and at least one other wagering game machine, performing operations comprising, transmitting, to a host gaming server, a player identifier associated with the player login and an authorization to receive the messages;

receiving, from the host gaming server, the messages, after the messages being filtered based on the player identifier and a theme of the at least one other wagering game machine; and displaying the messages on the at least one display device of the wagering game machine.

10. The method of claim 9, wherein the state of the wagering game machine that authorizes receipt of the messages comprises an active wagering game on the wagering game machine within a time period.

11. The method of claim 10, wherein the state of the wagering game machine that authorizes receipt of the messages comprises the active wagering game on the wagering game machine receiving monetary value beyond a monetary threshold within the time period.

12. The method of claim 9, further comprising:

in response to a wagering game event occurring at the wagering game machine, transmitting, from the wagering game machine to the host gaming server, an event notification message describing the wagering game event to the host gaming server, wherein the event notification indicates at least one of the player login, a win that exceeds a first monetary threshold, and a progressive win that exceeds a second monetary threshold.

13. The method of claim 9, wherein the theme of the at least one other wagering game machine is within a subset of themes of wagering game machines where money wagered is the most within a defined time period.

14. The method of claim 9, wherein displaying the messages comprises displaying the messages according to an order of priority, wherein messages about game play from the at least one other wagering game machine has the theme that is the same as a theme of the wagering game machine.

15. A wagering game machine comprising:

a first input device configured to detect a physical item associated with a monetary value that establishes a credit balance;

a second input device configured to receive a cashout input that initiates a payout from the credit balance;

at least one display device;

at least one processor; and at least one memory device configured to store instructions that, when executed by the at least one processor, cause the wagering game machine to:

receive, via the at least one input device, a player login for play of a wagering game at the wagering game machine;

present the wagering game on which monetary value can be wagered;

determine an outcome of the wagering game based, at least in part, on one or more random elements generated by a random number generator;

display the outcome on the at least one display device;

award a tangible award in response to the outcome meeting a predetermined award criterion; and in response to the wagering game machine being in a state that authorizes receipt of messages from multiple messaging sources that comprise at least one of a social networking website and another wagering game machine, performing operations comprising, transmit, to a host gaming server, a player identifier associated with the player login and an authorization to receive the messages;

receive, from the host gaming server, the messages after being filtered based on the player identifier and a theme of the other wagering game machine; and display the messages on the at least one display device of the wagering game machine.

16. The wagering game machine of claim 12, wherein the state of the wagering game machine that authorizes receipt of the messages comprises an active wagering game play on the wagering game machine within a time threshold.

17. The wagering game machine of claim 13, wherein the state of the wagering game machine that authorizes receipt of the messages comprises the active wagering game play on the wagering game machine beyond a monetary threshold within the time threshold.

18. The wagering game machine of claim 12, further comprising:

in response to a wagering game play event occurring at the wagering game machine, transmitting, from the wagering game machine to the host gaming server, an event notification message describing the wagering game event to the host gaming server, wherein the wagering game play event comprises at least one of the player login for the wagering game play at the wagering game machine, a win that exceeds a first monetary threshold, and a progressive win that exceeds a second monetary threshold.

19. One or more non-transitory machine-readable storage media including instructions which, when executed by one or more processors, cause the one or more processors to perform operations comprising:

receiving, at a host gaming server, a notification of an account login from a first wagering game machine from a wagering game establishment wherein the first wagering game machine comprises a first input device configured to detect a physical item associated with a monetary value that establishes a credit balance and a second input device configured to receive a cashout input that initiates a payout from the credit balance;

receiving, at the host gaming server, messages from a social networking website and a second wagering game machine at the wagering game establishment, wherein the messages indicate game play at the second wagering game machine, and activities inside and outside of the wagering game establishment;

aggregating, by the host gaming server, the messages;

configuring, by the host gaming server, a filter for the messages, wherein the filter is derived from at least one of account information associated with the account login, and a theme associated with the second wagering game machine;

filtering, by the host gaming server, the messages based on the filter to create filtered messages; and transmitting, by the host gaming server, the filtered messages to the first wagering game machine; and transmitting, by the host gaming server, wagering game information for presenting a wagering game on a display device of the first wagering game machine, wherein an outcome the wagering game is based, at least in part, on one or more random elements generated by a random number generator, and wherein a tangible award is credited in response to the outcome.

20. The one or more non-transitory machine-readable storage media of claim 19, wherein the filter varies based on a game play state of the first wagering game.

21. The one or more non-transitory machine-readable storage media of claim 20, wherein the filtered messages are displayed at the first wagering game machine, in response to the game play state being an active state.

22. The one or more non-transitory machine-readable storage media of claim 20, wherein the filtered messages are displayed at the first wagering game machine, in response to at least one of a game play rate of the first wagering game machine exceeding a game play rate threshold, and a coin-in rate of the first wagering game machine exceeding a coin-in threshold.

23. The one or more non-transitory machine-readable storage media of claim 19, wherein the configuring of the filter of the messages is based on input from an operator of the wagering game establishment.

24. The one or more non-transitory machine-readable storage media of claim 19, wherein the operations comprise transmitting, by the host gaming server, at least some of the messages related to the activity at the wagering game establishment to the social networking website for posting a notification on the social networking website.

25. The one or more non-transitory machine-readable storage media of claim 19, wherein the theme of the second wagering game machine is within a subset of themes of wagering game machines where money wagered is the most within a defined time period.

26. The one or more non-transitory machine-readable storage media of claim 19, wherein the messages that indicate game play at the second wagering game machine relate to the theme that is the same as a theme of the first wagering game machine.

27. An apparatus comprising:

means for receiving, at a host gaming server, a notification of an account login from a first wagering game machine from at least one wagering game establishment, wherein the first wagering game machine comprises a first input device configured to detect a physical item associated with a monetary value that establishes a credit balance and a second input device configured to receive a cash-out input that initiates a payout from the credit balance;

means for receiving, at the host gaming server, messages from a social networking website and a second wagering game machine at the wagering game establishment, wherein the messages indicate game play at the second wagering game machine, and activities inside and outside of the wagering game establishment;

means for aggregating, by the host gaming server, the messages;

means for configuring, by the host gaming server, a filter for the messages, wherein the filter is derived from at least one of a player identifier associated with the account login and a theme of the second wagering game machine;

means for filtering, by the host gaming server, the messages based on the filter to create filtered messages; and means for transmitting, by the host gaming server, the filtered messages and wagering game information for presenting a wagering game on a display device of the first wagering game machine, wherein an outcome of the play of the wagering game is based, at least in part, on one or more random elements generated by a random number generator, and wherein a tangible award is credited in response to the outcome meeting a predetermined award criterion.

28. The apparatus of claim 27, wherein the filter varies based on a game play state of the first wagering game machine that is to receive the messages that have been filtered, wherein the filtered messages are displayed at the first wagering game machine, in response to the game play state being active.

29. The apparatus of claim 27, wherein the filtered messages are displayed at the first wagering game machine, in response to at least one of a rate of a game play at the first wagering game machine exceeding a game play threshold and a rate of coin-in exceeding a coin-in threshold.

30. The apparatus of claim 27, wherein the theme of the second wagering game machine is within a subset of themes of wagering game machines where money wagered is the most within a defined time period.

31. The apparatus of claim 27, wherein the messages that indicate game play at the second wagering game machine relate to the theme that is the same as a theme of the first wagering game machine.

* * * * *